US006032304A

United States Patent [19]

Nam

[11] Patent Number: 6,032,304

[45] Date of Patent: Mar. 7, 2000

[54] SWIMMING POOL CONTAINING SALTWATER FOR BUOYANCY

[76] Inventor: Chul-woo Nam, 751-2, Sungjung-dong, Chunan-shi, Chungcheongnam-do, Rep. of Korea, 330-170

[21] Appl. No.: 09/171,722

[22] PCT Filed: Apr. 24, 1997

[86] PCT No.: PCT/KR97/00063

§ 371 Date: Oct. 23, 1998

§ 102(e) Date: Oct. 23, 1998

[87] PCT Pub. No.: WO97/40246

PCT Pub. Date: Oct. 30, 1997

[30] Foreign Application Priority Data

Apr. 24, 1996 [KR] Rep. of Korea ..... 96-12705
Jun. 1, 1996 [KR] Rep. of Korea ..... 96-19530

[51] Int. Cl.[7] ..... E04H 4/00; E04H 4/14

[52] U.S. Cl. ..... 4/488; 4/505

[58] Field of Search ..... 4/488, 489, 505, 4/506, 904

[56] References Cited

U.S. PATENT DOCUMENTS

| | | | |
|---|---|---|---|
| 520,342 | 5/1894 | Sutro | 4/488 X |
| 3,460,166 | 8/1969 | Weber | 4/505 X |
| 3,571,819 | 3/1971 | Puncochar | 4/487 |
| 4,754,502 | 7/1988 | Bowen | 4/487 |
| 4,991,239 | 2/1991 | Corna et al. | 4/505 |

FOREIGN PATENT DOCUMENTS

| | | |
|---|---|---|
| 394217 | 3/1993 | European Pat. Off. . |
| 0653531 | 10/1997 | European Pat. Off. . |

*Primary Examiner*—Henry J. Recla
*Assistant Examiner*—Kathleen J. Prunner
*Attorney, Agent, or Firm*—Baker & Botts, L.L.P.

[57] ABSTRACT

A swimming pool is provided that is filled with water containing salt to give buoyancy to a swimmer and to enable the swimmer to effortlessly float. The pool is formed of two or more sections with each section filled with the swimming pool water having differing densities of salt to provide for different buoyancy levels therein. Further, the water in the swimming pool also contains magnesium chloride, calcium sulfate, potassium sulfate and magnesium bromide.

2 Claims, 1 Drawing Sheet

SWIMMING POOL CONTAINING SALTWATER FOR BUOYANCY

TECHNICAL FIELD

The present invention relates to a swimming pool containing saltwater to give buoyancy, which provides a plurality of sections for holding saltwater, each section containing different salt densities such that dissimilar levels of buoyancy are provided in the sections to allow a beginning swimmer to gradually familiarize himself or herself to water and more easily learn how to swim.

BACKGROUND ART

Generally, swimming pools use tap water which is treated with chlorine and other chemicals to maintain the water in a clean and ideal pH level state.

There are also swimming pools that utilize water containing germanium (Ge), hot spring water containing sulfur, or other natural waters. The purpose of these swimming pools is to offer health benefits to the swimmer. However, swimmers normally only wade and relax in such swimming pools rather than swim in them.

In conventional swimming pools using treated tap water, the novice swimmer often uses a flotation device such as a tube or a life-jacket until he or she learns how to swim. These flotation devices, although effective when used for safety, are limited in aiding the novice to learn how to swim and can, in fact, be detrimental as the swimmer becomes overly dependent on the flotation device and finds difficulty in weaning himself or herself off from this reliance.

There is a need for swimming pool water which provides buoyancy so that a beginner can become familiarized to the water and learn how to swim. Further, there is a need for a swimming pool which is structured having sections using the above swimming pool water with differing degrees of buoyancy so that the learning process for the swimmer is gradual and, as a result, very effective.

DISCLOSURE OF INVENTION

The present invention has been made in an effort to fulfill the above needs.

It is an object of the present invention to provide a swimming pool containing saltwater to both give buoyancy to a swimmer and provide health benefits by stimulating the skin and promoting metabolism inside the body. Further, it is an object to provide a swimming pool having sections filled with the swimming pool water of differing salt densities so that different buoyancy levels are present in each of the sections to gradually accustom the swimmer to the water, helping to aid in the swimming learning process.

To achieve the above objects, the present invention provides a swimming pool filled with water containing salt for buoyancy. The swimming pool is comprised of two or more sections, each section filled with the swimming pool water having differing densities of salt to provide for different buoyancy levels therein. Further, the water in the swimming pool also contains magnesium chloride, calcium sulfate, potassium sulfate, and magnesium bromide.

BRIEF DESCRIPTION OF DRAWINGS

The accompanying drawings, which are incorporated in and constitute a part of the specification, illustrate an embodiment of the invention, and, together with the description, serve to explain the principles of the invention.

BEST MODE FOR CARRYING OUT THE INVENTION

Preferred embodiments of the present invention will now be described in detail with reference to the accompanying drawings.

The present invention uses the following means to achieve the object of providing a swimming pool containing saltwater to enable a swimmer to effortlessly float.

First, density of salt in the water is set at roughly 23–25% to provide buoyancy to the swimmer such that he or she floats.

Second, sodium chloride, magnesium chloride, calcium sulfate, potassium sulfate, magnesium bromide, calcium carbonate, etc. are combined to water for added health benefits.

Third, the swimming pool is structured having a plurality of sections with each section having a different density of salt content for differing degrees of buoyancy to allow the swimmer to gradually accustom himself or herself to the water. For example, a first section can have a 25% salt content for full buoyancy and the last section can contain no salt so that no extra buoyancy is provided in the water.

Figure 1:
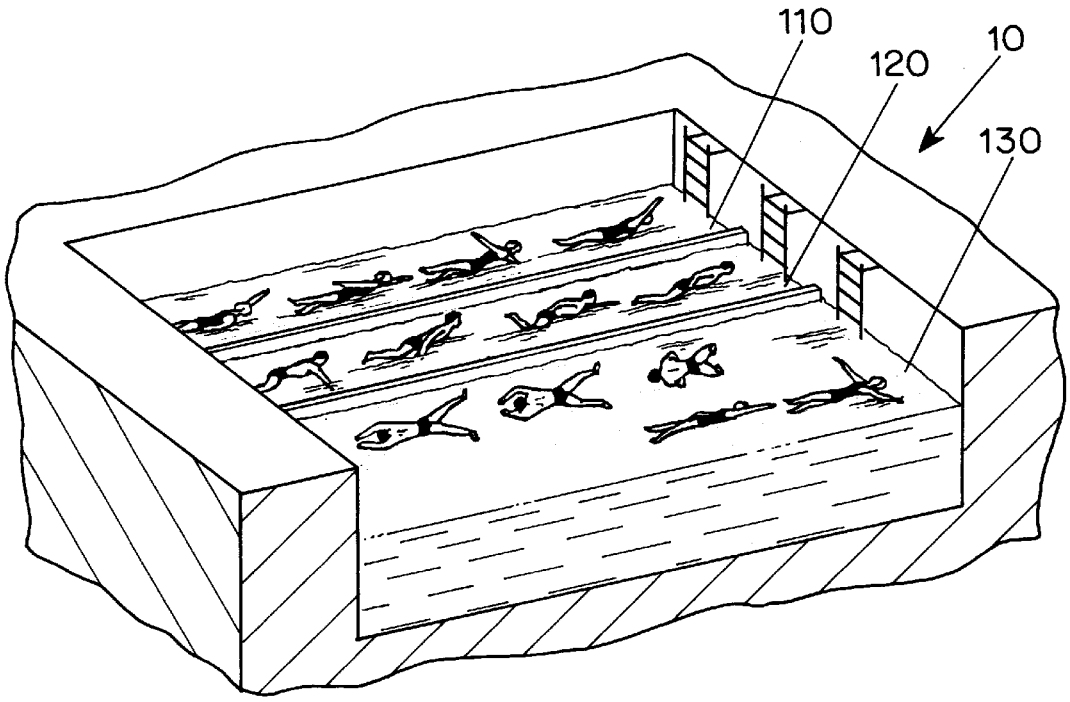
FIG. 1 is a drawing illustrating a swimming pool structure having a plurality of sections according to a is preferred embodiment of the present invention.

Referring to FIG. 1, there is shown a drawing illustrating a swimming pool having a plurality of sections according to a preferred embodiment of the present invention. In the drawing, there is shown a swimming pool 10 including a first section 110 filled with water having a salt density that keeps the swimmer afloat with no effort, a second section 120 filled with water having a salt density that requires a medium degree of effort by the swimmer to keep afloat, and a third section 130 filled with water containing no salt such that full effort is needed by the swimmer to keep afloat.

All swimming strokes (i.e., freestyle, back-stroke, breast-stroke, butterfly, side-stroke) have certain commonalities. Namely, the swimmer moves his or her arms from the front of the body to the back of the body, making sure the hands are positioned to give forward propulsion throughout the entire movement, and kicks or scissors his or her legs for further forward thrust.

The novice swimmer encounters a variety of problems which cause him or her to have difficulty in staying afloat. For example, problems often result during the returning of the arms toward the front of the body after stroking toward the rear of the body. That is, it is often during this phase in each of the swimming strokes that the novice swimmer either performs the returning motion incorrectly or not quickly enough, resulting in the swimmer often trying to compensate by bending at the waist which worsens the problem and causes the swimmer to sink.

The present invention remedies this problem by providing the swimmer with either full or partial buoyancy so that the swimmer can practice swimming or a new stroke without sinking. The following is an explanation of the scientific basis for the present invention.

The human body is more buoyant in saltwater than in freshwater. An analysis of saltwater will produce the following results of the elements after the water is removed:

sodium chloride (77.4%), magnesium chloride (4.74%), calcium sulfate (3.60%), potassium sulfate (2.46%), magnesium bromide (0.23%), calcium carbonate (0.34%), including small amounts of chlorine, sodium, calcium, sulfur, magnesium, carbon, bromine, strontium, fluorine, boron, lithium, nitrogen, iron, manganese, phosphor, copper, barium, iodine, silver, arsenic, zinc, gold, and radium. However, tests show that it is the sodium chloride, or table salt, in seawater which provides for buoyancy. Further, the higher the salt content, the higher the degree of buoyancy. Salbwater normally has a 4–6% salt content, or roughly 35 g in one liter of saltwater. However, the Red Sea has 40 g of salt per one liter of saltwater, while the Baltic Sea has only 7 g.

The Dead Sea, on the other hand, has a 23–25% salt volume, with bromine existing at a level roughly 100 times greater than normal seawater. Also, except for plankton, no living organisms live in the Dead Sea. So, although the Dead Sea contains a large amount of calcium chloride, manganese, and bromine, it is the high salt content (23–25%) that provides the buoyancy to keep a person afloat.

Therefore, it is with the object of approaching a level of buoyancy as exists in the Dead Sea that the present invention has been made. But in the present invention, bromide, as it is harmful to the body, is not added to the water.

The following are further reasons as to why salt is added. to swimming pool water.

First, the buoyancy offered by mixing salt into water helps to rid the swimmer of the fear of swimming to better enable him or her to learn how to swim.

Second, it is very effective for the swimmer to be in a constant prone position when practicing different swimming strokes.

Third, swimming in water having a high degree of salinity brings health benefits for the skin by stimulating the same, and by promoting metabolism inside the body.

Fourth, this will have religious significance for some as the swimming pool filled with water containing salt closely mimics the conditions existing in the Dead Sea.

Finally, the novelty to be able to float on, water without exerting swimming effort will bring commercial benefits to the pool owner.

Figure 2:
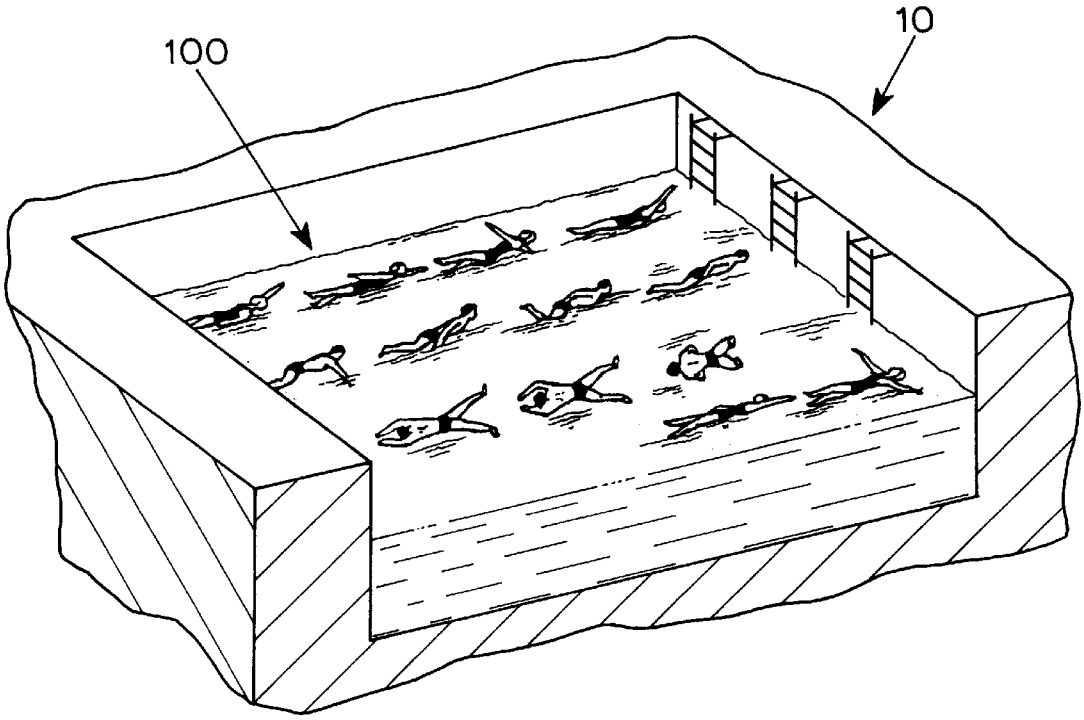
FIG. 2 is a drawing illustrating a swimming pool laving a single-section structure filled with swimming pool water containing salt according to a preferred embodiment of the present invention.

Referring now to FIG. 2, there is shown a drawing illustrating a swimming pool 10 having a single-section structure filled with swimming pool water containing salt according to a preferred embodiment of the present invention. As shown in the drawing, the swimming pool 10 has only a single swimming receptacle 100. The swimming receptacle 100 is filled with swimming pool water of the present invention.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

I claim:

1. A swimming pool filled with water containing salt for buoyancy wherein the swimming pool is comprised of two or more sections, each section filled with the swimming pool water having differing densities of salt to provide for different buoyancy levels therein.

2. The swimming pool of claim 1, wherein the water in the swimming pool also contains magnesium chloride, calcium sulfate, potassium sulfate, and magnesium bromide.

* * * * *